US011391093B2

(12) United States Patent
Anttila

(10) Patent No.: US 11,391,093 B2
(45) Date of Patent: Jul. 19, 2022

(54) APPARATUS, ROCK BREAKING MACHINE AND METHOD OF MONITORING ROCK BREAKING MACHINE

(71) Applicant: SANDVIK MINING AND CONSTRUCTION OY, Tampere (FI)

(72) Inventor: Erkki Anttila, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 17/209,697

(22) Filed: Mar. 23, 2021

(65) Prior Publication Data

US 2021/0301594 A1 Sep. 30, 2021

(30) Foreign Application Priority Data

Mar. 30, 2020 (EP) ..... 20166668

(51) Int. Cl.

| | |
|---|---|
| ***E21B 7/02*** | (2006.01) |
| ***E21B 1/36*** | (2006.01) |
| ***E21B 6/00*** | (2006.01) |

(52) U.S. Cl.

CPC ..... *E21B 7/025* (2013.01); *E21B 1/36* (2020.05); *E21B 6/00* (2013.01); *E21B 7/022* (2013.01)

(58) Field of Classification Search

CPC ..... E21B 1/00; E21B 1/12; E21B 1/14; E21B 1/16; E21B 1/18; E21B 1/20; E21B 1/22; E21B 1/24; E21B 1/26; E21B 1/28; E21B 1/30; E21B 1/32; E21B 1/34; E21B 1/36; E21B 1/38; E21B 7/025

See application file for complete search history.

(56) References Cited

U.S. PATENT DOCUMENTS 3,685,593 A * 8/1972 Amtsberg ..... B25D 9/265 173/14

FOREIGN PATENT DOCUMENTS

| | | | |
|---|---|---|---|
| CN | 209195248 | U | 8/2019 |
| EP | 2811106 | A1 | 12/2014 |
| JP | H08135204 | A | 5/1996 |
| WO | 03033216 | A1 | 4/2003 |

* cited by examiner

*Primary Examiner* — Kristyn A Hall
(74) *Attorney, Agent, or Firm* — Corinne R. Gorski

(57) ABSTRACT

A hydraulic rock breaking machine and an apparatus and method for monitoring operation of the same is provided. The apparatus includes at least one pneumatic sensor arranged for monitoring an inner space of the machine and at least one control unit configured to receive and process the pneumatic sensing data.

12 Claims, 4 Drawing Sheets

APPARATUS, ROCK BREAKING MACHINE AND METHOD OF MONITORING ROCK BREAKING MACHINE

RELATED APPLICATION DATA

This application claims priority under 35 U.S.C. § 119 to EP Patent Application No. 20166668.2, filed on Mar. 30, 2020, which the entirety thereof is incorporated herein by reference.

TECHNICAL FIELD

The present disclosure invention relates to a hydraulic rock breaking machine and to a method for monitoring the same.

BACKGROUND

In mines and construction sites there exists a need to break rock material. The rock material to be broken may be stones or boulders whereby hydraulic breaking hammers are implemented. When breaking undetached rock material, hydraulic drilling machines are used for making drill holes prior to blasting the rock surface. Both these types of hydraulic rock breaking machines are equipped with hydraulically operable percussion devices. Operation of the percussion device and the entire rock breaking machine needs to be monitored in order to control the machine properly. Therefore different measuring and monitoring systems are developed for this purpose. However, the known monitoring systems have shown to include disadvantages.

SUMMARY

An object of the present disclosure is to provide a novel and improved rock breaking machine, more specifically a rock drilling machine, and method for monitoring operation of a rock breaking machine.

An aspect of the disclosed solution is that an apparatus for monitoring a hydraulically operable rock breaking machine is disclosed. The apparatus includes one or more pressure sensing devices, sensors or measuring elements configured to sense pneumatic pressure variations inside the hydraulic rock breaking machine. The machine includes a percussion device provided with a piston moving in an impact direction and a return direction.

The percussion piston of the hydraulic percussion device is moved by means of pressurized hydraulic fluid. The reciprocating movement of the percussion piston causes pressure fluctuation inside the machine and this can be sensed by means of the sensing device or element. The apparatus further includes one or more control devices configured to receive sensed pressure data from the sensing device. The control unit may process the received sensing data and may provide monitoring data.

An advantage of the disclosed solution is that reciprocating movement of a hydraulically movable percussion piston can be monitored conveniently by sensing gas pressure variations inside the machine. The gathered gas pressure data may be analyzed and implemented in a versatile manner Use and mounting of the pneumatic sensing means is straightforward. Furthermore, the pneumatic pressure sensors are durable and inexpensive.

An additional advantage is that the disclosed pneumatic monitoring system may substitute other known monitoring systems based on complicated, vulnerable, unstable and expensive sensing means and arrangements.

According to an embodiment, the control unit is configured to detect pneumatic pressure variations in the sensing data and is configured to determine percussion rate of the percussion device in response to detected pneumatic pressure variations.

According to an embodiment, the control unit is configured to detect pneumatic pressure variations in the sensing data and is configured to determine length of travel of a piston of the percussion device in response to the detected pneumatic pressure variations. For example, the pressure change is inversely proportional to volume change that is caused by the piston movement and this could be converted to travelling distance of the piston.

According to an embodiment, the control unit is configured to detect pneumatic pressure variations in the sensing data and is configured to determine striking moment of time of a piston of the percussion device in response to detected pneumatic pressure variations. The striking moments can be noted as peak values in the pressure sensing data. The peak values in function of time may be either highest or lowest values depending on whether the pneumatic pressure is detected at front of the piston or at its rear.

According to an embodiment, the control unit is configured to detect a so called striking point on the basis of the above mentioned data. This may be useful in order to detect whether feeding of the rock breaking machine is correct or not. The control unit may also determine suitable control values for feed force and rate. Thereby the rock breaking process can be controlled to be as effective as possible and without causing unnecessary loads to the structure.

According to an embodiment, the control unit is configured to detect pneumatic pressure variations in the sensing data and is configured to determine and analyze any other details regarding the movement of the piston. The control unit may also be provided with additional sensing signals from other type of sensor and measuring devices. The control unit may combine the gathered data and may calculate in a versatile manner different characterizing values for control and monitoring purposes.

According to an embodiment, the control unit is configured to detect pneumatic pressure variations in the sensing data and is configured to determine and analyze smoothness of movement of the piston. When abnormal movements, such as jerking and delays are noted, it may indicate of wearing or damage of a control valve, for example.

According to an embodiment, the control unit is configured to determine speed of the piston in both directions, i.e. in the impact and return directions on the basis of the received sensing data. The determined speed of the piston provides valuable information on used impact energy and recoil. In other words, operation and contact between the rock and a tool may provide information on rock material being broken. The control unit may be provided with suitable algorithms and programs for analyzing and calculating the needed data on the basis of the pneumatic pressure data. The gathered rock data may be utilized for controlling the actual rock breaking and may also be utilized later for other purposes such as when considering reinforcing of the rock.

According to an embodiment, the control unit is configured to compare the sensed pneumatic pressures to input reference data and is configured indicate detected deviations. Detected abnormal pressure values may trigger the control unit to initiate execution of further analyzing and control measures. Further, the control unit may indicate an operator of the detected deviations.

According to an embodiment, the control unit is provided with at least one pressure limit value and the control unit is configured to compare the sensed pneumatic pressures to the input pressure limit value.

According to an embodiment, the control unit is configured to store data on sensed previous pneumatic pressures and is configured to compare newly sensed pneumatic pressures with the stored history data on sensed pneumatic pressures in order to notify deviations and trends in the operation of the hydraulic rock breaking machine.

According to an embodiment, the control unit is provided with several input scenarios based on which the control unit is configured to determine a condition state of the hydraulic rock breaking machine itself, a condition state of lubrication system of the hydraulic rock drilling machine or an operational situation or condition of the rock drilling process.

According to an embodiment, the pressure sensing device is a pressure sensor or pressure sensing apparatus or element.

According to an embodiment, the pressure sensing device is a pneumatic pressure sensor.

According to an embodiment, the pressure sensing device is a hydraulic pressure sensor, which is configured to sense pneumatic pressures.

According to an embodiment, the pneumatic pressure sensing device is a low pressure sensor operable under pressures of 10 bar. An advantage of this embodiment is that low pressure sensors are inexpensive and well available. Furthermore, the structure and operation thereof may be reliable.

According to an embodiment, the pneumatic pressure inside the rock breaking machine is sensed indirectly vs. the embodiments using pressure sensors. The sensing device may be configured to sense effects of the pneumatic pressure fluctuations by utilizing other sensing technologies. The sensing device may include force sensors, torque sensors, acceleration sensors or any other sensors of devices suitable for the purpose. Thus, the sensing device may be a strain gauge, for example.

According to an embodiment, the solution relates to a hydraulic rock breaking machine, which is intended to be mounted to a working machine and which includes a body and a percussion device, which is hydraulically operable and mounted inside the body. The percussion device generates impact pulses by means of a reciprocating piston to a tool mountable to a front end of the body. The machine further includes one or more pneumatic sensors for sensing pneumatic pressure inside the body in order to monitor pneumatic pressure fluctuation caused by the piston of the hydraulic percussion device.

According to an embodiment, the rock breaking machine is a rock drilling machine. The rock drilling machine has a rotation device for turning a drilling tool around its longitudinal axis.

According to an embodiment, the rock breaking machine is a rock drilling machine provided with an oil mist lubrication system for providing pressurized air-oil mist flow inside the body. The rock drilling machine is provided with at least one pneumatic sensor for sensing pneumatic pressure of the air-oil mist prevailing inside the body. In other words, pressure fluctuation of the lubricating mist is sensed and the data on the fluctuation may be analyzed and used as it is disclosed in several embodiments disclosed herein.

According to an embodiment, the rock breaking machine is a rock drilling machine and includes an oil mist lubrication system for providing pressurized air-oil mist flow inside the body. The rock drilling machine has a shank at a front end of the body for connecting a drilling tool. The shank is rotated by means of a rotating device via a gearing surrounding the shank. The oil mist lubricating system lubricates a front space surrounding a rear end portion of the shank and the gearing. One or more pneumatic sensors are in pneumatic connection with the front space and are arranged to sense pneumatic pressure of the air-oil mist prevailing inside the front space.

According to an embodiment, the rock breaking machine is a rock drilling machine that includes a rear space at a rear end portion of the body. The rear space is limited by a rear cover mounted releasably to the body. Further, the rear space is in pneumatic communication with a rear end of a reciprocating piston of the percussion device. The at least one pneumatic sensor is in pneumatic connection with the rear space and is arranged to sense pneumatic pressure prevailing inside the rear space.

According to an embodiment, the mentioned rear space is in fluid communication via a venting channel to an air-oil lubrication system. Thus, the pneumatic pressure of the rear space may be sensed either directly or by sensing the pressure of the air-oil lubrication system.

According to an embodiment, the rock breaking machine is a rock drilling machine that includes a feed port for feeding the pressurized air-oil mist, and lubricating ducts for conveying the air-oil mist to at least one lubricating target inside the body. One or more pneumatic sensors are arranged to sense pneumatic pressure prevailing inside the feed port or the lubricating ducts.

According to an embodiment, the rock breaking machine includes a lubrication system wherein lubrication oil and pressurized air are fed inside the body. The pressurized air or gas is configured to serve as a carrier medium for the lubrication oil. Thus, the machine may be provided with an oil circulating lubrication system. Further, the rock breaking machine is provided with one or more sensors for sensing pneumatic pressure of the carrier medium prevailing inside the body. In other words, there is pneumatic pressure inside the body and the piston causes pressure fluctuations, which may be monitored and the gathered data may be utilized as it is disclosed in this document.

According to an embodiment, the disclosed pneumatic sensor is mounted in direct connection with the inner space of the monitored inner space of the rock breaking machine. Accordingly, the pneumatic sensor is mounted close to the monitored inner space. The pneumatic sensor may then have direct exposure to the inner space such that no pressure losses and damping phenomena exist.

According to an embodiment, the disclosed pneumatic sensor is mounted directly to a body, a basic structure component or a cover limiting the inner space. When the sensor is directly mounted, the monitoring may be sensitive and accurate measuring results can be gathered. Further, the mounting may be rigid and straightforward. For example, the basic structure of the machine may have an opening provided with inner threads and the pneumatic sensor provided with outer threads may simply be screw mounted.

According to an embodiment, the disclosed pneumatic sensor is connected by means of a pneumatic channel to the monitored inner space. The pneumatic channel may be a tube, hose or a drilling made in the basic structure. Accordingly, the pneumatic sensor may be located a short distance from the monitored inner space. The distance between the monitored inner space and the pneumatic sensor is preferably as short as possible in order to ensure accurate sensing. An advantage of this embodiment is that it provides several alternative possibilities for the mounting of the sensors and when the location of the sensors may be selected more freely. Due to the connecting pneumatic channel, the sensors may be placed in positions where they are well protected and where is free space is available.

According to an embodiment, the rock breaking machine may be provided with quick connect couplings for mounting the disclosed pneumatic sensors in a removable manner to the monitored machine. Accordingly, the sensors are easy to mount and may be changed as needed. Further, the machine may be provided with the quick couplings at the factory and may be equipped with the sensors later on. The sensor may be coupled also for duration of a special monitoring period and may be thereafter easily removed, if so desired.

According to an embodiment, the rock breaking machine is provided with a dedicated monitoring space, which is pressurized with gas and inside which a rear end of the piston of the percussion device is configured to move. One or more pneumatic sensors are in pneumatic connection with the dedicated monitoring space and are configured to detect fluctuating pneumatic pressure caused by the reciprocating rear end of the piston.

According to an embodiment, the above mentioned dedicated monitoring space is formed only for the monitoring purpose. In this embodiment, the space is not for lubrication purposes.

According to an embodiment, constant gas pressure is fed to the mentioned dedicated monitoring space.

According to an embodiment, the dedicated monitoring space is prefilled with gas. The space is only provided with a gas feed port. No gas flow exists through the space.

According to an embodiment, inside the inner space of the monitored machine may be compressed air, air-lubricant mist or any inert gas, such as nitrogen.

The pressurized gas may be arrange inside the inner space solely for the monitoring purposes or it may simultaneously serve as flushing gas, lubricating gas or cooling gas.

According to an embodiment, the disclosed solution relates to a method. The method relates to monitoring operation of a hydraulic rock breaking machine. The method includes providing the rock breaking machine with at least one pressure sensor for providing pressure data for the monitoring. In the method prevailing pressure inside a body of the rock breaking machine is sensed by means of at least one pneumatic pressure sensing device. The sensed pneumatic pressure data is transmitted to at least one control unit wherein the sensed pneumatic pressure data is processed under for generating monitoring data.

According to an embodiment, the method includes determining operational condition of the rock breaking machine by examining the monitoring data.

According to an embodiment, the operational condition data may include data on rock material being processed, since by analyzing the pneumatic pressure data it is possible to detect whether the tool is penetrating into a hard or soft rock and whether there are cavities or fractures in the rock. Accordingly, characterized features of the rock may be determined and the gathered data may be stored and taken into account in the control of the machine and also in following other measures executed at the work site.

According to an embodiment, the operational condition data may include data on the recoil of the piston in the return direction. The detected recoil and movement speed in the return direction may be analyzed in more detail and utilized for generating control parameters or performance factors. By means of analyzing the recoil, i.e., the amount of energy transmitted back to the percussion device from the rock being broken, it is possible to determine properties of the rock, to determine whether operator of the machine uses the machine in a right manner and to determine whether proper settings and control parameters are implemented.

According to an embodiment, the operational condition data may have data on physical contact of the tool with the rock material being processed.

According to an embodiment, the operational condition data may include data on the speed of the piston in the return direction. Further, the system may monitor the movement of the piston and detect if any abnormal movement or speed exists. These issues may indicate that one or more components of the machine has failed and needs to be replaced before such can cause damage to other components.

According to an embodiment, the operational condition data may include data on the moment of generated impact and the moment when the piston is in its rear dead point.

According to an embodiment, the method further includes utilizing the monitoring data for providing predictive maintenance for the rock breaking machine. The monitoring may show that one or more components of the percussion device are not working properly and that abnormal behavior can therefore be notified. For example, it is possible to detect if a control valve controlling working cycle of the piston has failed. Movement of the control valve in opposite directions may be nonlinear and this can be noted by the disclosed monitoring. The control valve can be substituted with a new one early enough before the entire percussion device will be damaged. The disclosed monitoring provides usage based triggers for the service measures and ensure that the percussion device operates effectively and that no unpredictable interruptions occur in the operation of the rock breaking machine.

According to an embodiment, the method further includes controlling operating parameters of the rock breaking machine on the basis of the monitoring data. Accordingly, the monitoring data is utilized for detecting different drilling situations and phenomenon and suitable amendments to control parameters are made for controlling the operation. The control parameters may adjust operation of the percussion device. It is possible to adjust generated percussion rate and impact energy by adjusting the feeding of hydraulic fluid to the percussion device. In addition to, it is also possible to adjust other operational parameters of the rock breaking device and its assisting actuators. It is possible to adjust feed force of the breaking device towards the rock surface, for example. This way contact between the rock and the tool may be affected. When the breaking hammer is a rock drilling machine, rotation of the tool may be adjusted as well as flushing.

According to an embodiment, the disclosed pneumatic pressure sensing system may also be retrofitted to an existing hydraulic rock drilling machine or hydraulic rock breaking hammer. This way the machines may be updated with this new kind of monitoring system whenever desired.

According to an embodiment, the control unit of the disclosed monitoring system may be located on a carrier of a rock drilling rig or excavator. The sensing data gathered by means of the pneumatic pressure sensing devices may be transmitted to the control unit by a wired or wireless data communication path. Alternatively, or in addition to, the sensing data may be transmitted to one or more external control units, which may be personal computers, servers, cloud services or electrical terminal devices. In some cases it may be possible to provide rock breaking machine with a control unit and then provide it with a data communication connection with one or more other control devices or actuators.

According to an embodiment, the solution may relate to a rock drilling rig, including a movable carrier; at least one drilling boom connected movably to the carrier and equipped with a rock drilling unit; and wherein the rock drilling unit includes a feed beam and a hydraulic rock drilling machine supported movably on the feed beam; and wherein the drilling machine is disclosed herein and includes the disclosed pneumatic pressure sensing system.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

For the sake of clarity, the figures show some embodiments of the disclosed solution in a simplified manner. In the figures, like reference numerals identify like elements.

DETAILED DESCRIPTION

Figure 1:
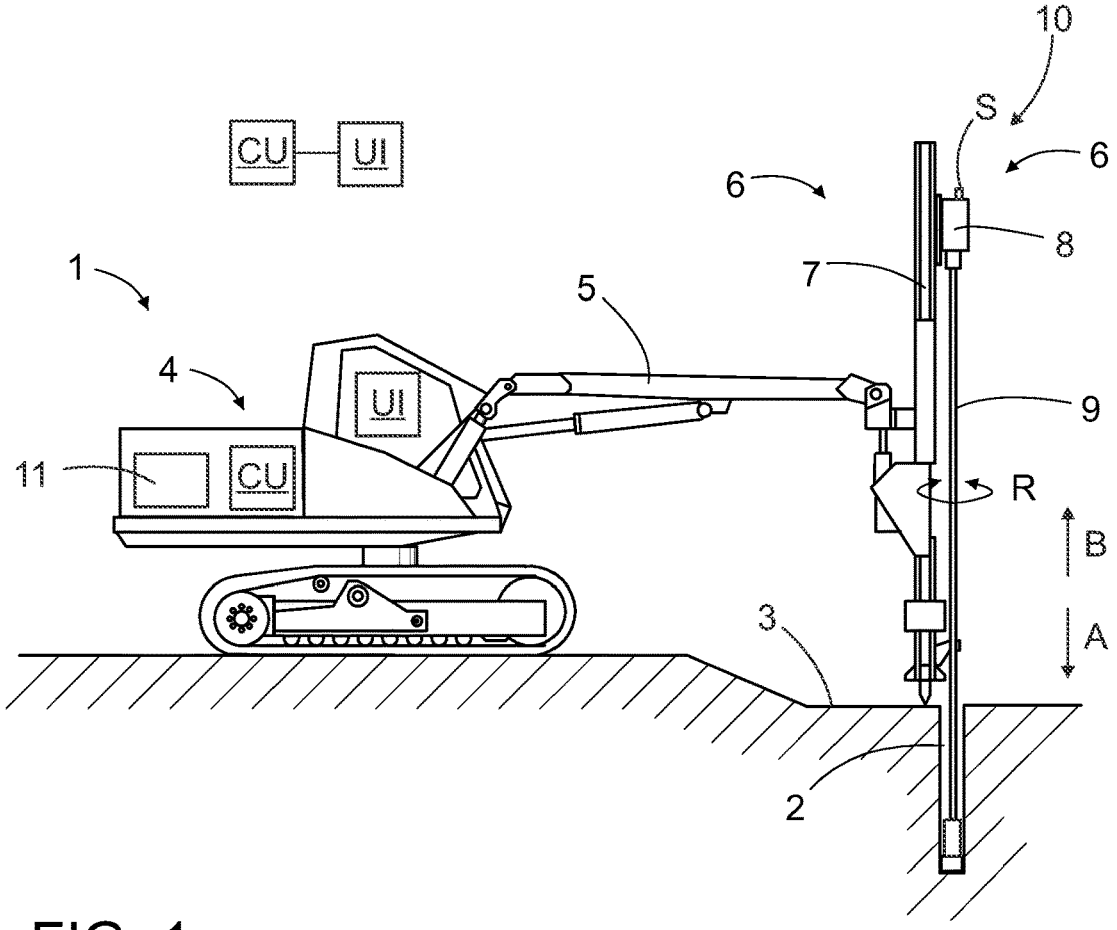
FIG. 1 is a schematic side view of a rock drilling rig, wherein a hydraulic rock drilling machine is provided with a pneumatic monitoring system.

FIG. 1 shows a rock drilling rig 1 intended for drilling drill holes 2 in a rock surface 3. In this case the rock drilling rig 1 is intended for surface drilling, but the same principles disclosed apply also for underground drilling machines. The rock drilling rig 1 includes a movable carrier 4 and one or more drilling booms 5 connected to the carrier 4. At a distal end portion of the drilling boom 5 is a rock drilling unit 6 provided with a feed beam 7 and a rock drilling machine 8 supported thereon.

A drilling tool 9 is connectable to the rock drilling machine 8. The rock drilling machine 8 is a hydraulic rock breaking machine 10, which is connected to a hydraulic system powered by a hydraulic unit 11. The rock drilling machine 8 includes a percussion device for generating impact pulses to the tool 9 in impact direction A. The rock drilling machine 8 also includes a rotating device R for turning the tool 9 around its longitudinal axis. The rock drilling machine 8 is further provided with one or more pneumatic sensors S, whereby the rock drilling machine 8 is instrumented. In other words, the hydraulically operated machine is examined by means of pneumatic sensing means.

The rock drilling rig 1 may have one or more control units CU, which receive measuring signals from the sensors S and process the input sensing data. The control unit CU may be a dedicated device intended for the pneumatic monitoring system, or alternatively, a basic control unit of the rig 1 may serve also a processor for the pneumatic monitoring system. Alternatively, or in addition to, the system may have one or more external control units CU. Data communication between the sensors S and the on-board control unit CU may be wired or wireless. Further, the system may include at least one user interface UI or display unit through which the system may provide an operator with the monitoring data and by means of which the operator may input data, parameters, computer programs and make selections.

Figure 2:
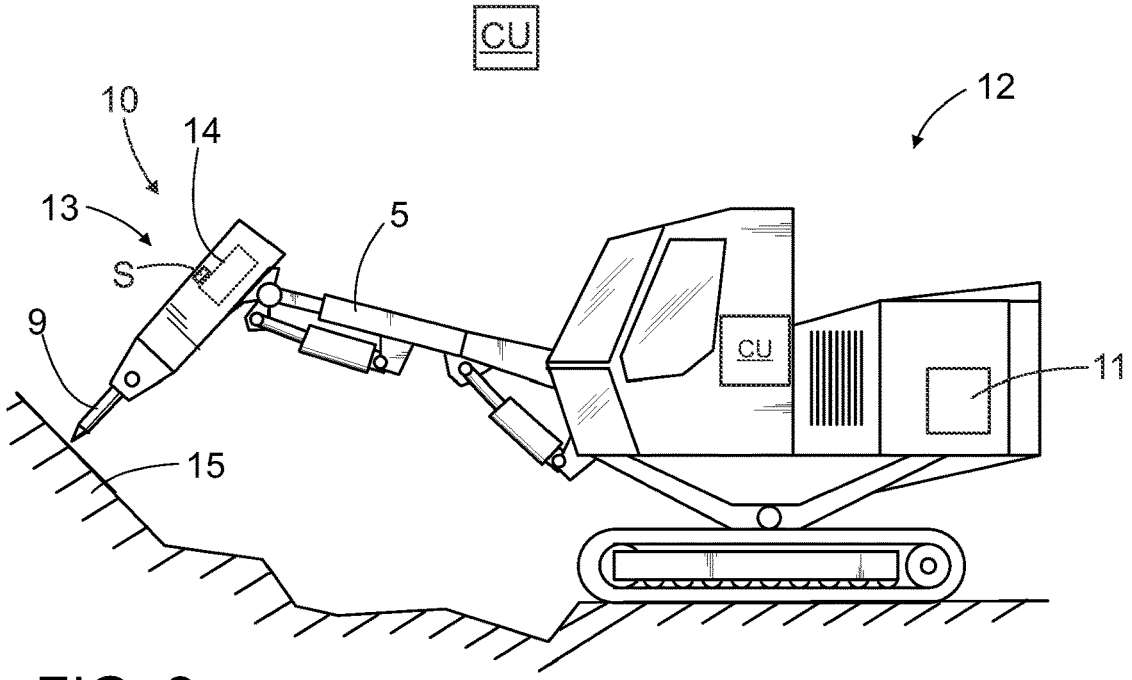
FIG. 2 is a schematic view of a work machine wherein a hydraulic rock breaking hammer is provided with a pneumatic monitoring system.

FIG. 2 discloses an excavator 12, which is provided with boom 5 and hydraulic breaking hammer 13 at a distal end of the boom. The breaking hammer 13 is a hydraulic breaking machine 10 connected to a hydraulic system of the excavator 12 and is powered by means of a hydraulic unit 11. The breaking hammer 13 includes a percussion device 14, which is intended to provide a tool 9 with impact pulses for breaking rock material 15. The breaking hammer 13 is provided with one or more pneumatic sensors S, which monitor operation of the machine 10. Sensing data is transmitted to an on-board control unit CU or to an external control unit. The sensors S may detect pressure fluctuation inside the breaking hammer, which fluctuation is caused by a reciprocating percussion piston of the percussion device 14.

Figure 3:
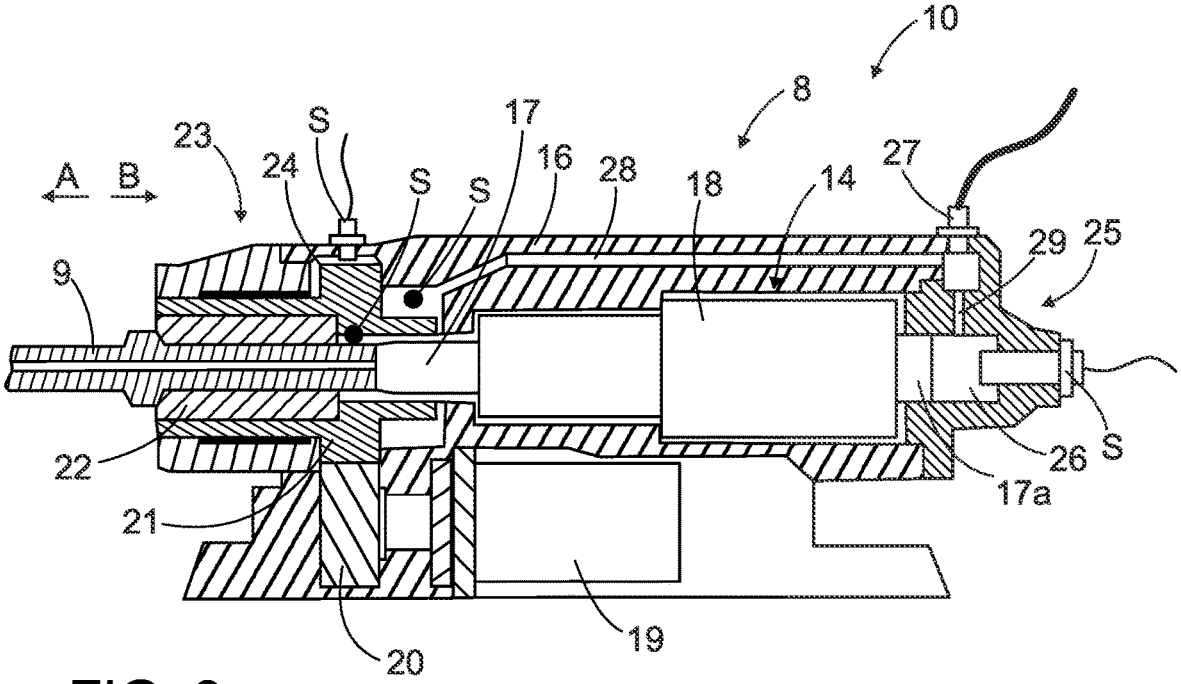
FIG. 3 is a schematic view of a hydraulic rock drilling machine and pneumatic sensors arranged at possible measuring points.

FIG. 3 is a highly simplified presentation of a hydraulic rock drilling machine 8. The drilling machine 8 includes a main body 16 inside which is a percussion device 14 including a percussion piston 17. The piston 17 moves in a reciprocating manner towards impact direct A and return direction B. A front end of the piston 17 strikes rear end of tool 9. The tool 9 transmits impact pulses to a rock surface processed.

The piston 17 is controlled by means of control valve 18, which may be located around the piston 17. The tool 9 is rotated around its longitudinal axis by means of a rotating device 19, which may be arranged to transmit the generated rotation via a gear 20 and rotation bushing 21 to a chuck 22 which receives the tool 9 or shank adapter. A front cover 23 may form a gear housing 24 surrounding the rotation means. At an opposite rear end of body 16 is a rear cover 25, which includes an inner rear space 26, which is in communication with a rear end 17*a* of the piston 17.

The machine 10 may be provided with an air-oil lubrication system, whereby air-oil mist is fed through a feed port 27 inside the rear cover 25. The gaseous lubrication medium is conveyed through lubrication channel 28 to the front part of the machine 10 in order to lubricate the rotation gearing, the shank adapter and their bearings. Thus, inside the gearing housing 24 is an inner space wherein pressurized gaseous lubrication medium prevails.

As it is shown, there may be one or more pneumatic sensors S mounted at the front part of the machine 10 for detecting gas pressures therein. Further, the air-oil lubrication system may be in fluid connection with the inner rear space 26. There may be a narrow venting channel 29 for allowing the lubrication system to be vented to the inner rear space 26 whereby gas pressure prevails also therein.

The rear cover 25 is provided with a pneumatic sensor S for sensing pressure in the space 26. When the rear end portion 17*a* of the piston 17 moves forwards and backwards, it causes pressure fluctuation inside the space 26 and this can be sensed by means of the sensor S. The movement of the piston 17 causes pneumatic pressure variations also in the front part of the machine 10 and they can also be detected by means of the sensors located at the front end portion.

An alternative to the solution shown in FIG. 3 is that there is no venting channel 29 to the lubrication system, but instead there is a gas feed port for providing the inner space 26 with any other gaseous medium. Also the pressure variations can be measured by means of one or more pneumatic sensors S.

Figure 4:
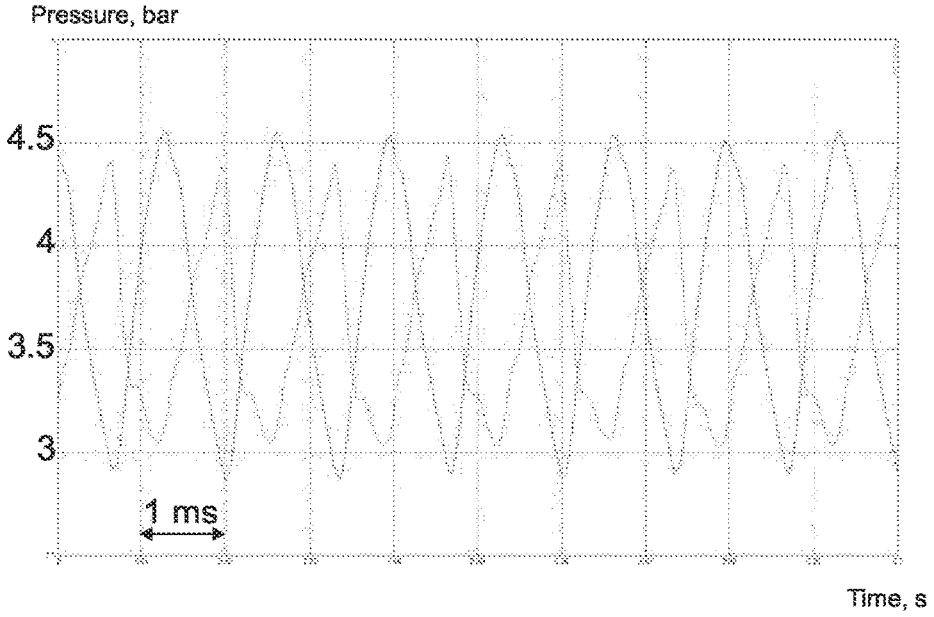
FIG. 4 is a diagram showing some pressure curves in function of time.

FIG. 4 shows two pressure curves of pneumatic sensors mounted to a rear portion of a percussion device (a curve with greater amplitude) and mounted to a front portion (smaller amplitude). Movement of a piston of the percussion device may be analyzed based on the pressure data and the curves. When the piston moves in the impact direction, then pressure decreases at the rear portion and correspondingly when the piston moves in the return direction, pressure increases. More detailed analyzing programs allow use of the pressure data in a versatile manner. It has been noticed, that interesting curves are gathered from the sensors inside a rear cover of the machine and in volume spaces where the piston is striking. Thus, in practical solutions, the rear cover appears to be the best place to measure. Moreover, the rear cover area is usually well accessible and, in many cases, a threaded hole that could be used for a sensor already exists therein or can be easily made.

Figure 5:
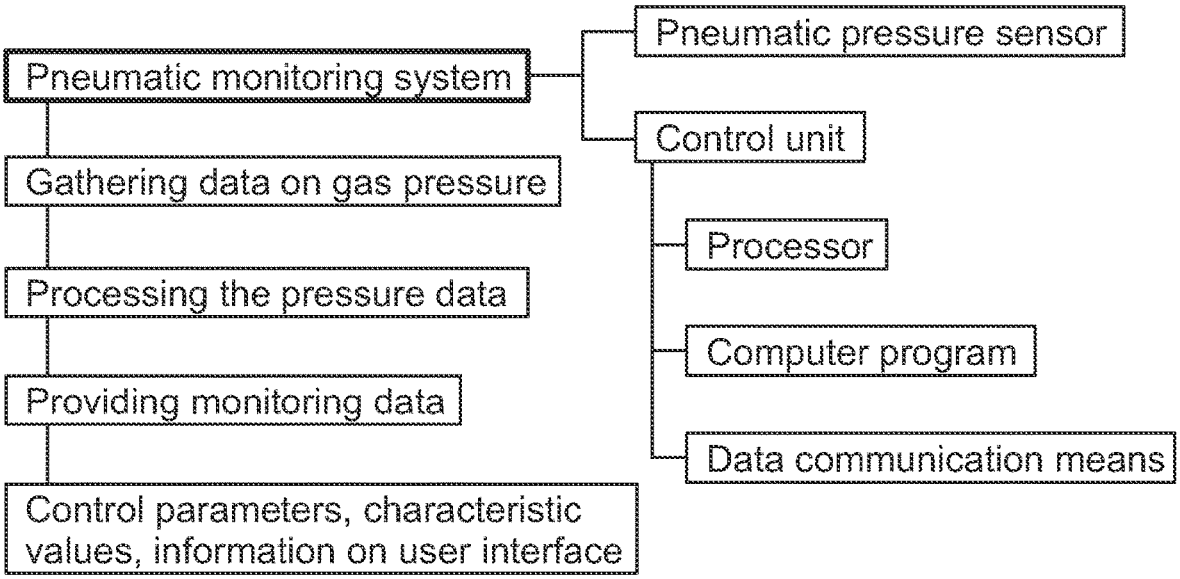
FIG. 5 is a diagram showing some basic features relating to a pneumatic monitoring system.

FIG. 5 shows a simplified diagram showing basic components of the disclosed pneumatic monitoring system and basic process steps executed in the monitoring. The presented issues have already been disclosed above in this document.

Figure 6:
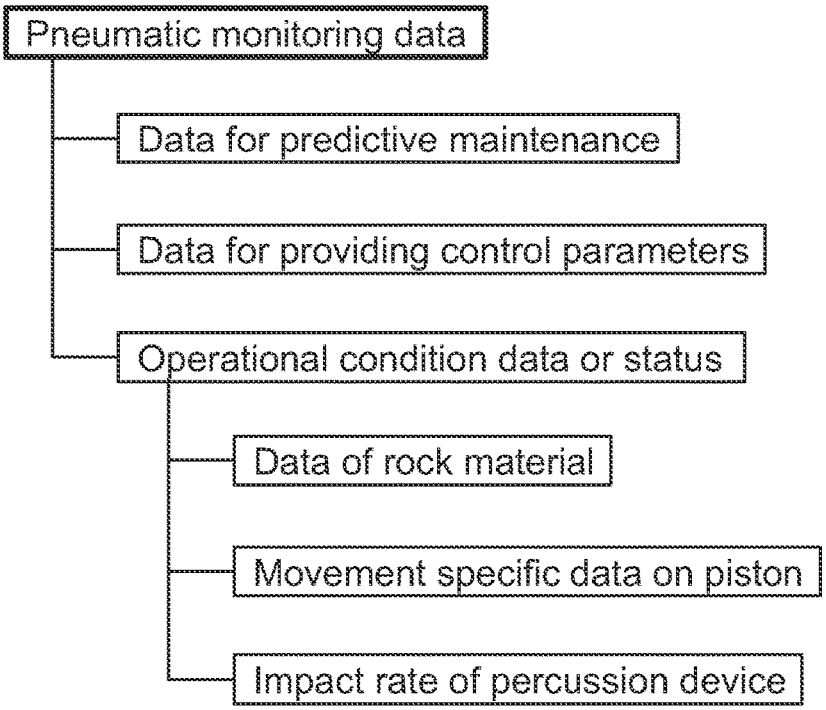
FIG. 6 is a diagram showing possible use cases for the generated monitoring data.

FIG. 6 discloses some possible applications for the monitoring data produced by the disclosed pneumatic monitoring system. The figure is self-explanatory, and further, the presented issues have already been disclosed above in this document.

Figure 7:
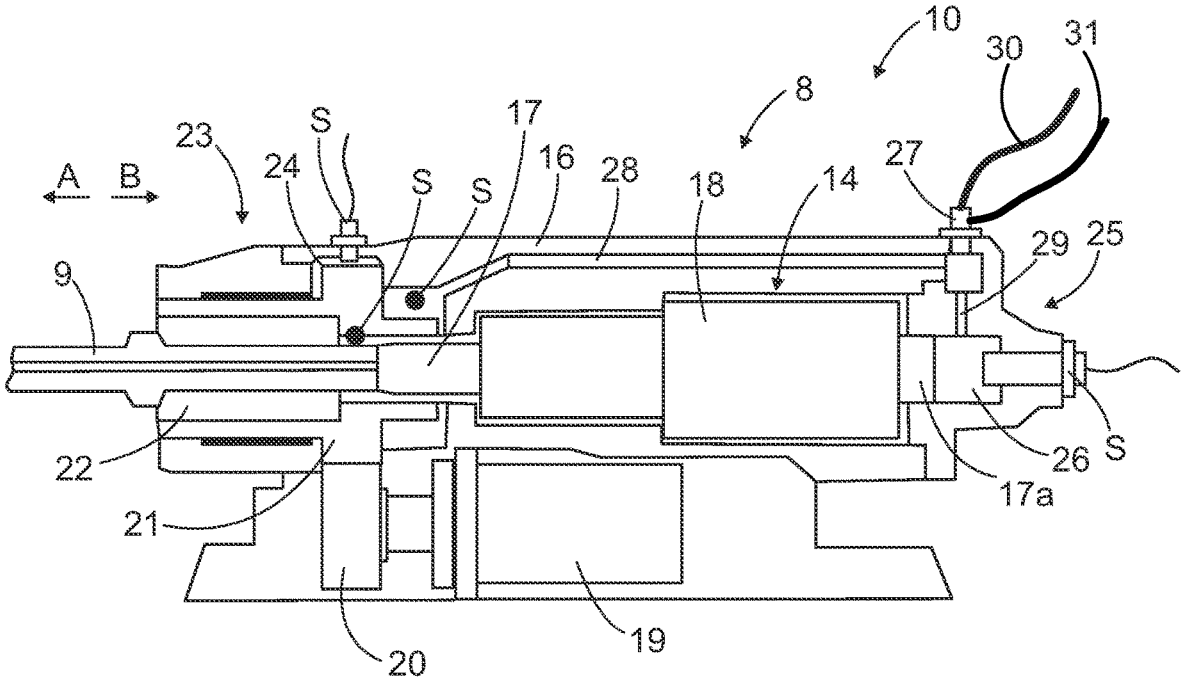
FIG. 7 is a schematic view of a hydraulic rock drilling machine provided with a circulation lubrication system and including several pneumatic sensors arranged at possible measuring points.

FIG. 7 discloses a rock drilling machine provided with an oil circulation system wherein pressurized air is fed through a channel 30 and lubrication oil is fed through a channel 31. The pressurized air makes the oil to circulate inside the body. Otherwise, the solution of FIG. 7 may correspond to that shown in FIG. 3.

Figure 8:
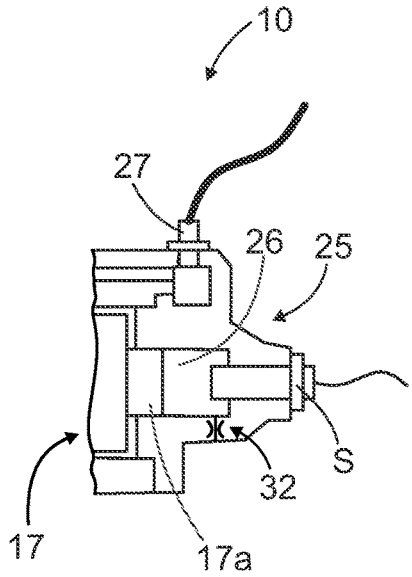
FIG. 8 is a schematic view of a rear space of the breaking machine including an inner space with a pneumatic space and pneumatic sensing arrangement.

FIG. 8 discloses end cover 25 of a breaking machine. Inner space 26 is provided with breathing channel 32, which may be provided with a throttle device, which may have fixed adjustment or it may be adjustable. In this case, the inner space is not connected to the lubrication system as it is in solutions disclosed in FIGS. 3 and 7. Sensor S may detect pressure fluctuations inside the space 26 caused by the reciprocating movement of the hydraulically moved piston 17.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A hydraulic rock drilling machine arranged to be mounted to a work machine, the rock drilling machine comprising:

a body;

a percussion device mounted inside the body, the percussion device being hydraulically operated, whereby a reciprocating percussion piston of the percussion device is moved by means of pressurized hydraulic fluid, and the percussion device being configured to generate impact pulses by means of the reciprocating piston to a drilling tool mountable to a front end of the body;

at least one apparatus for sensing prevailing fluid pressure inside the rock drilling machine, wherein the apparatus includes at least one pressure sensing device arranged for sensing pressure of fluid inside the rock drilling machine, and at least one control unit configured to receive sensed pressure data from the at least one pressure sensing device, wherein the control unit is configured to process the received sensing data and to provide monitoring data in accordance with a control strategy input to the control unit;

an oil mist lubrication system arranged for providing pressurized air-oil mist flow, the oil mist lubrication system being disposed inside the body; and at least one sensor of the at least one pressure sensing device being arranged for sensing pneumatic pressure of the air-oil mist prevailing inside the body and arranged to monitor pneumatic pressure fluctuation caused by the hydraulically movable piston of the hydraulic percussion device.

2. The rock drilling machine as claimed in claim 1, further comprising a shank adapter arranged for connecting the drilling tool, the shank adapter or the drilling tool being rotated by a rotating device via a gearing surrounding the shank adapter or the drilling tool, the oil mist lubricating system being configured to lubricate a front space surrounding a rear end portion of the shank adapter or the drilling tool and the gearing, wherein the at least one sensor is a pneumatic sensor in pneumatic connection with the front space and is arranged to sense pneumatic pressure of the air-oil mist prevailing inside the front space.

3. The rock drilling machine as claimed in claim 1, further comprising a rear space located at a rear end portion of the body, wherein the rear space is limited by a rear cover mounted releasably to the body, the rear space being in pneumatic communication with a rear end of the reciprocating piston of the percussion device, and wherein the at least one sensor is a pneumatic sensor in pneumatic connection with the rear space and is arranged to sense pneumatic pressure prevailing inside the rear space.

4. The rock drilling machine as claimed in claim 1, further comprising a feed port arranged for feeding the pressurized air-oil mist, and lubricating ducts for conveying the air-oil mist to at least one lubricating target inside the body, the at least one sensor being a pneumatic sensor arranged to sense pneumatic pressure prevailing inside the feed port or the lubricating ducts.

5. The rock drilling machine as claimed in claim 1, wherein the at least one sensor is mounted in direct connection with a monitored inner space of the rock drilling machine, wherein the at least one sensor is mounted close to the monitored inner space.

6. The rock drilling machine as claimed in claim 1, further comprising a dedicated monitoring space which is pressurized with gas and inside which a rear end of the piston of the percussion device is configured to move, and wherein the at least one sensor is in pneumatic connection with the dedicated monitoring space and is configured to detect fluctuating pneumatic pressure caused by the reciprocating rear end of the piston.

7. The rock drilling machine as claimed in claim 1, wherein lubrication oil and pressurized air of the oil mist lubrication system are fed inside the body, and wherein the pressurized air is configured to serve as a carrier medium for the lubrication oil, the at least one sensor being arranged to sense pneumatic pressure of the carrier medium prevailing inside the body.

8. A method for monitoring operation of a hydraulic rock drilling machine, the method comprising:

providing the rock drilling machine with at least one sensing device for providing pressure data for the monitoring;

providing pressurized air-oil mist flow inside a body of the rock drilling machine to lubricate the rock drilling machine;

sensing pneumatic pressure of the prevailing air-oil mist inside the body of the rock drilling machine by means of the at least one sensing device;

transmitting the sensed pneumatic pressure data to at least one control unit; and processing the sensed pneumatic pressure data in the control unit and generating monitoring data.

9. The method as claimed in claim 8, further comprising determining operational condition of the rock drilling machine by examining the monitoring data.

10. The method as claimed in claim 8, further comprising utilizing the monitoring data for providing predictive maintenance for the rock drilling machine.

11. The method as claimed in claim 8, further comprising controlling operating parameters of the rock drilling machine on the basis of the monitoring data, whereby the monitoring data is utilized for detecting different rock breaking situations and for controlling them.

12. The method as claimed in claim 8, further comprising determining speed of a piston of a percussion device of the rock drilling machine in an impact direction and a return direction in response to the detected pneumatic pressure variations.

* * * * *